US009513041B2

(12) United States Patent
Haikawa

(10) Patent No.: US 9,513,041 B2
(45) Date of Patent: Dec. 6, 2016

(54) AIR CONDITIONER

(71) Applicant: DAIKIN INDUSTRIES, LTD., Osaka-Shi, Osaka (JP)

(72) Inventor: Tomoyuki Haikawa, Kusatsu (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/394,661

(22) PCT Filed: Apr. 4, 2013

(86) PCT No.: PCT/JP2013/060368

§ 371 (c)(1),
(2) Date: Oct. 15, 2014

(87) PCT Pub. No.: WO2013/157405

PCT Pub. Date: Oct. 24, 2013

(65) Prior Publication Data

US 2015/0068236 A1 Mar. 12, 2015

(30) Foreign Application Priority Data

Apr. 16, 2012 (JP) ..... 2012-093125

(51) Int. Cl.

| | |
|---|---|
| ***F25D 21/02*** | (2006.01) |
| ***F25B 43/00*** | (2006.01) |
| ***F25B 40/02*** | (2006.01) |
| ***F25B 49/02*** | (2006.01) |
| *F25B 13/00* | (2006.01) |

(Continued)

(52) U.S. Cl.

CPC ..... *F25B 43/00* (2013.01); *F25B 40/02* (2013.01); *F25B 49/02* (2013.01); *F24F 1/0059* (2013.01);

(Continued)

(58) Field of Classification Search

CPC ..... F25B 43/00; F25B 49/02; F25B 40/02; F25B 2313/0315; F25B 2700/2104

USPC ..... 62/225

See application file for complete search history.

(56) References Cited

U.S. PATENT DOCUMENTS 4,869,073 A * 9/1989 Kawai et al. ..... 62/160
5,181,392 A * 1/1993 Itoh et al. ..... 62/160

(Continued)

FOREIGN PATENT DOCUMENTS

JP 60-57142 A 4/1985
JP H08320160 A * 12/1996

(Continued)

OTHER PUBLICATIONS

Hiroki et al., Air Conditioner, May 29, 2008, JP2008121996A, Whole Document.*

(Continued)

*Primary Examiner* — M. Alexandra Elve
*Assistant Examiner* — Larry Furdge
(74) *Attorney, Agent, or Firm* — Birch, Stewart, Kolasch & Birch, LLP

(57) ABSTRACT

COP deteriorates when a dehumidification operation is executed. In an air conditioner of the present invention, an indoor heat exchanger includes an auxiliary heat exchanger 20 and a main heat exchanger 21 provided leeward from the auxiliary heat exchanger 20. When the air conditioner is driven in a predetermined dehumidification operation mode, a liquid refrigerant supplied to the auxiliary heat exchanger 20 fully evaporates midway in the auxiliary heat exchanger 20. For this reason, only an upstream part of the auxiliary heat exchanger functions as an evaporation region, and an area downstream of the evaporation region of the auxiliary heat exchanger 20 is a superheat region. When the load is high at the selection of a dehumidification operation to start driving, a cooling operation is started and then switching to the dehumidification operation is executed in accordance with the decrease in the load.

8 Claims, 5 Drawing Sheets

(51) Int. Cl.
*F24F 1/00* (2011.01)
*F24F 11/00* (2006.01)
*F24F 3/14* (2006.01)

(52) U.S. Cl.
CPC *F24F 2003/1446* (2013.01); *F24F 2011/0046* (2013.01); *F24F 2011/0064* (2013.01); *F25B 13/00* (2013.01); *F25B 2313/0234* (2013.01); *F25B 2313/0314* (2013.01); *F25B 2313/0315* (2013.01); *F25B 2700/2104* (2013.01)

(56) References Cited

U.S. PATENT DOCUMENTS

| | | | | |
|---|---|---|---|---|
| 5,305,822 | A * | 4/1994 | Kogetsu et al. | 165/225 |
| 5,771,703 | A * | 6/1998 | Rajendran | F25B 41/062 236/78 D |
| 2009/0013715 | A1* | 1/2009 | Setoguchi et al. | 62/524 |
| 2009/0230202 | A1* | 9/2009 | Matsui et al. | 236/44 A |

FOREIGN PATENT DOCUMENTS

| | | | | |
|---|---|---|---|---|
| JP | 9-14727 | A | | 1/1997 |
| JP | H10-325621 | A | | 12/1998 |
| JP | 2001-062755 | A | | 3/2001 |
| JP | 2003-148830 | A | | 5/2003 |
| JP | 2004-108618 | A | | 4/2004 |
| JP | 2004-251537 | A | | 9/2004 |
| JP | 2005-273923 | A | | 10/2005 |
| JP | 2006-170503 | A | | 6/2006 |
| JP | 2006-177573 | A | | 7/2006 |
| JP | 2007010200 | A | * | 1/2007 |
| JP | 2008121996 | A | * | 5/2008 |
| JP | 2010-091127 | A | | 4/2010 |
| JP | 2012-17889 | A | | 1/2012 |

OTHER PUBLICATIONS

Isao et al., Air Conditioner and its Control Method, Jan. 18, 2007, JP2007010200A, Whole Document.*

Masakazu, Heat Pump Type Air Conditioner, Dec. 3, 1996, JPH08320160A, Whole Document.*

International Search Report issued in PCT/JP2013/060368, dated May 14, 2013.

Extended European Search Report issues Feb. 11, 2016 in corresponding European Application No. 13777479.0.

* cited by examiner

AIR CONDITIONER

TECHNICAL FIELD

The present invention relates to an air conditioner configured to perform a dehumidification operation.

BACKGROUND ART

There has been a conventional air conditioner in which: an auxiliary heat exchanger is disposed rearward of a main heat exchanger; and a refrigerant evaporates only in the auxiliary heat exchanger to locally perform dehumidification so that dehumidification can be performed even under a low load (even when the number of revolution of a compressor is small), for example, when the difference between room temperature and a set temperature is sufficiently small and therefore the required cooling capacity is small.

CITATION LIST

Patent Literature

Patent Literature 1: Japanese Unexamined Patent Publication No. 14727/1997 (Tokukaihei 09-14727)

SUMMARY OF INVENTION

Technical Problem

When, however, this air conditioner employs the method of solely cooling the auxiliary heat exchanger from the start while the indoor temperature is high, the cooling capacity is insufficient and the room temperature is not immediately decreased.

The COP (coefficient of performance) therefore deteriorates when the dehumidification operation is performed.

An object of the present invention is to provide an air conditioner in which the influence of the deterioration of the COP due to the dehumidification operation is minimized.

Solution to Problem

According to the first aspect of the invention, an air conditioner includes a refrigerant circuit in which a compressor, an outdoor heat exchanger, an expansion valve, and an indoor heat exchanger are connected to one another, the air conditioner configured to perform a cooling operation in which the entirety of the indoor heat exchanger functions as an evaporation region and a dehumidification operation in which a part of the indoor heat exchanger functions as the evaporation region, wherein, when a load is high at the selection of the dehumidification operation to start driving, the cooling operation is started and then switching to the dehumidification operation is executed in accordance with the decrease in the load.

In this air conditioner, when the load is high at the execution of the operation for starting the dehumidification operation, sufficient dehumidification is possible even in the cooling operation on account of a low temperature of the heat exchanger, and hence dehumidification and cooling are efficiently and simultaneously done by starting the cooling operation. As the load decreases with the decrease in the room temperature, the operation is switched to the dehumidification operation since dehumidification in the cooling operation becomes impossible on account of an increased evaporation temperature. In this way, the influence of the deterioration of the COP due to the dehumidification is minimized.

According to the second aspect of the invention, the air conditioner of the first aspect is arranged such that, the load is detected based on a difference between an indoor temperature and a set temperature.

In this air conditioner, the load is detected based on a difference between an indoor temperature and a set temperature.

According to the third aspect of the invention, the air conditioner of the first or second aspect is arranged such that the load is detected based on a frequency of the compressor.

In this air conditioner, the load is detected based on a frequency of the compressor.

According to the fourth aspect of the invention, the air conditioner of any one of the first to third aspects is arranged such that, after the start of a cooling operation, switching to a dehumidification operation is not executed when an evaporation temperature is lower than a predetermined temperature.

In this air conditioner, because the evaporation temperature is lower than the predetermined temperature when the load becomes equal to or lower than a predetermined value, dehumidification is possible without the switching from the cooling operation to the dehumidification operation.

Advantageous Effects of Invention

As described above, the following effects are attained by the present invention.

According to the first aspect of the invention, when the load is high, sufficient dehumidification is possible even in the cooling operation on account of a low temperature of the heat exchanger. On this account, dehumidification and cooling are efficiently and simultaneously done by starting the cooling operation. As the load decreases with the decrease in the room temperature, the operation is switched to the dehumidification operation since dehumidification in the cooling operation becomes impossible on account of an increased evaporation temperature. In this way, the influence of the deterioration of the COP due to the dehumidification is minimized.

According to the second aspect of the invention, the load is detected based on a difference between an indoor temperature and a set temperature.

According to the third aspect of the invention, the load is detected based on a frequency of the compressor.

According to the fourth aspect of the invention, because the evaporation temperature is lower than the predetermined temperature when the load becomes equal to or lower than a predetermined value, dehumidification is possible without the switching from the cooling operation to the dehumidification operation.

DESCRIPTION OF EMBODIMENTS

The following describes an air conditioner 1 of an embodiment of the present invention.

<Overall Structure of Air Conditioner 1>

Figure 1:
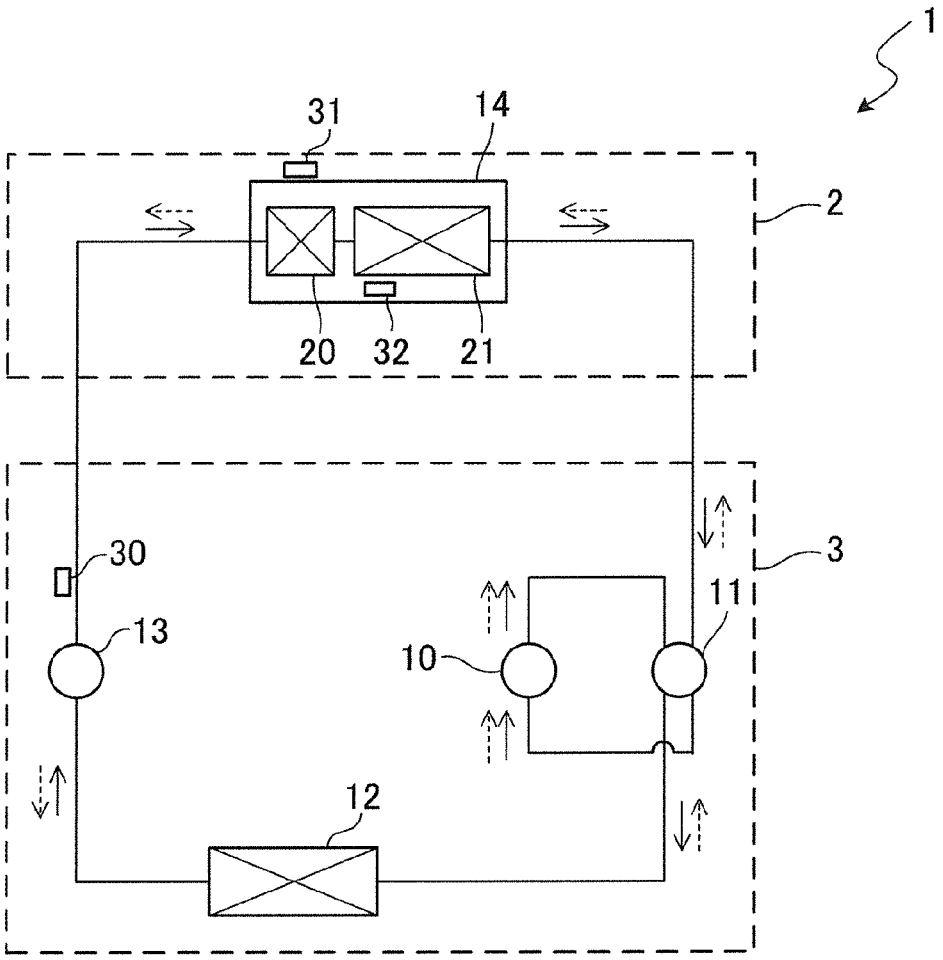
FIG. 1 is a circuit diagram showing a refrigerant circuit of an air conditioner of an embodiment of the present invention.
Figure 2:
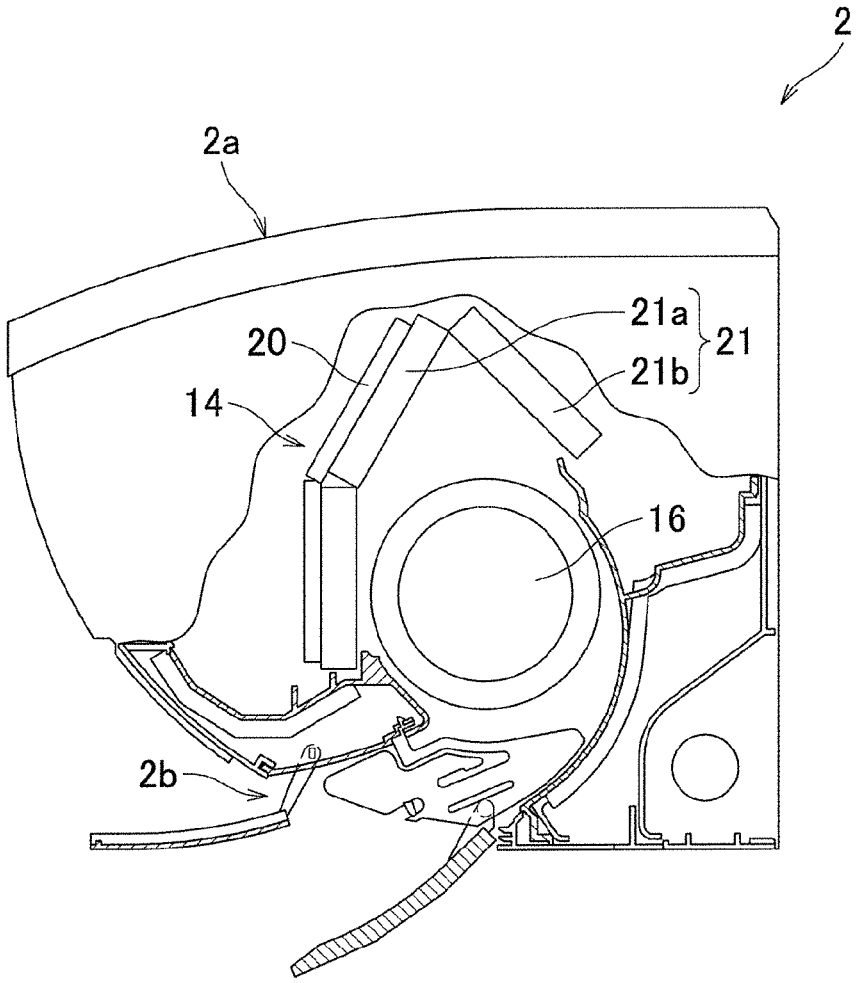
FIG. 2 is a schematic cross section of an indoor unit of the air conditioner of the embodiment of the present invention.

As shown in FIG. 1, the air conditioner 1 of this embodiment includes: an indoor unit 2 installed inside a room; and an outdoor unit 3 installed outside the room. The air conditioner 1 further includes a refrigerant circuit in which a compressor 10, a four-way valve 11, an outdoor heat exchanger 12, an expansion valve 13, and an indoor heat exchanger 14 are connected to one another. In the refrigerant circuit, the outdoor heat exchanger 12 is connected to a discharge port of the compressor 10 via the four-way valve 11, and the expansion valve 13 is connected to the outdoor heat exchanger 12. Further, one end of the indoor heat exchanger 14 is connected to the expansion valve 13, and the other end of the indoor heat exchanger 14 is connected to an intake port of the compressor 10 via the four-way valve 11. The indoor heat exchanger 14 includes an auxiliary heat exchanger 20 and a main heat exchanger 21.

In the air conditioner 1, operations in a cooling operation mode, in a predetermined dehumidification operation mode, and in a heating operation mode are possible. Using a remote controller, various operations are possible: selecting one of the operation modes to start the operation, changing the operation mode, stopping the operation, and the like. Further, using the remote controller, it is possible to adjust indoor temperature setting, and to change the air volume of the indoor unit 2 by changing the number of revolutions of an indoor fan.

As indicated with solid arrows in the figure, in the cooling operation mode and in the predetermined dehumidification operation mode, there are respectively formed a cooling cycle and a dehumidification cycle, in each of which: a refrigerant discharged from the compressor 10 flows, from the four-way valve 11, through the outdoor heat exchanger 12, the expansion valve 13, and the auxiliary heat exchanger 20, to the main heat exchanger 21 in order; and the refrigerant having passed through the main heat exchanger 21 returns back to the compressor 10 via the four-way valve 11. That is, the outdoor heat exchanger 12 functions as a condenser, and the indoor heat exchanger 14 (the auxiliary heat exchanger 20 and the main heat exchanger 21) functions as an evaporator.

Meanwhile, in the heating operation mode, the state of the four-way valve 11 is switched, to form a heating cycle in which: the refrigerant discharged from the compressor 10 flows, from the four-way valve 11, through the main heat exchanger 21, the auxiliary heat exchanger 20, and the expansion valve 13, to the outdoor heat exchanger 12 in order; and the refrigerant having passed through the outdoor heat exchanger 12 returns back to the compressor 10 via the four-way valve 11, as indicated with broken arrows in the figure. That is, the indoor heat exchanger 14 (the auxiliary heat exchanger 20 and the main heat exchanger 21) functions as a condenser, and the outdoor heat exchanger 12 functions as an evaporator.

The indoor unit 2 has, on its upper surface, an air inlet 2*a* through which indoor air is taken in. The indoor unit 2 further has, on a lower portion of its front surface, an air outlet 2*b* through which air for air conditioning comes out. Inside the indoor unit 2, an airflow path is formed from the air inlet 2*a* to the air outlet 2*b*. In the airflow path, the indoor heat exchanger 14 and a cross-flow indoor fan 16 are disposed. Therefore, as the indoor fan 16 rotates, the indoor air is taken into the indoor unit 1 through the air inlet 2*a*. In a front portion of the indoor unit 2, the air taken in through the air inlet 2*a* flows through the auxiliary heat exchanger 20 and the main heat exchanger 21 toward the indoor fan 16. Meanwhile, in a rear portion of the indoor unit 2, the air taken in through the air inlet 2*a* flows through the main heat exchanger 21 toward the indoor fan 16.

As described above, the indoor heat exchanger 14 includes: the auxiliary heat exchanger 20; and the main heat exchanger 21 located downstream of the auxiliary heat exchanger 20 in an operation in the cooling operation mode or in the predetermined dehumidification operation mode. The main heat exchanger 21 includes: a front heat exchanger 21*a* disposed on a front side of the indoor unit 2; and a rear heat exchanger 21*b* disposed on a rear side of the indoor unit 2. The heat exchangers 21*a* and 21*b* are arranged in a shape of a counter-V around the indoor fan 16. Further, the auxiliary heat exchanger 20 is disposed forward of the front heat exchanger 21*a*. Each of the auxiliary heat exchanger 20 and the main heat exchanger 21 (the front heat exchanger 21*a* and the rear heat exchanger 21*b*) includes heat exchanger pipes and a plurality of fins.

Figure 3:
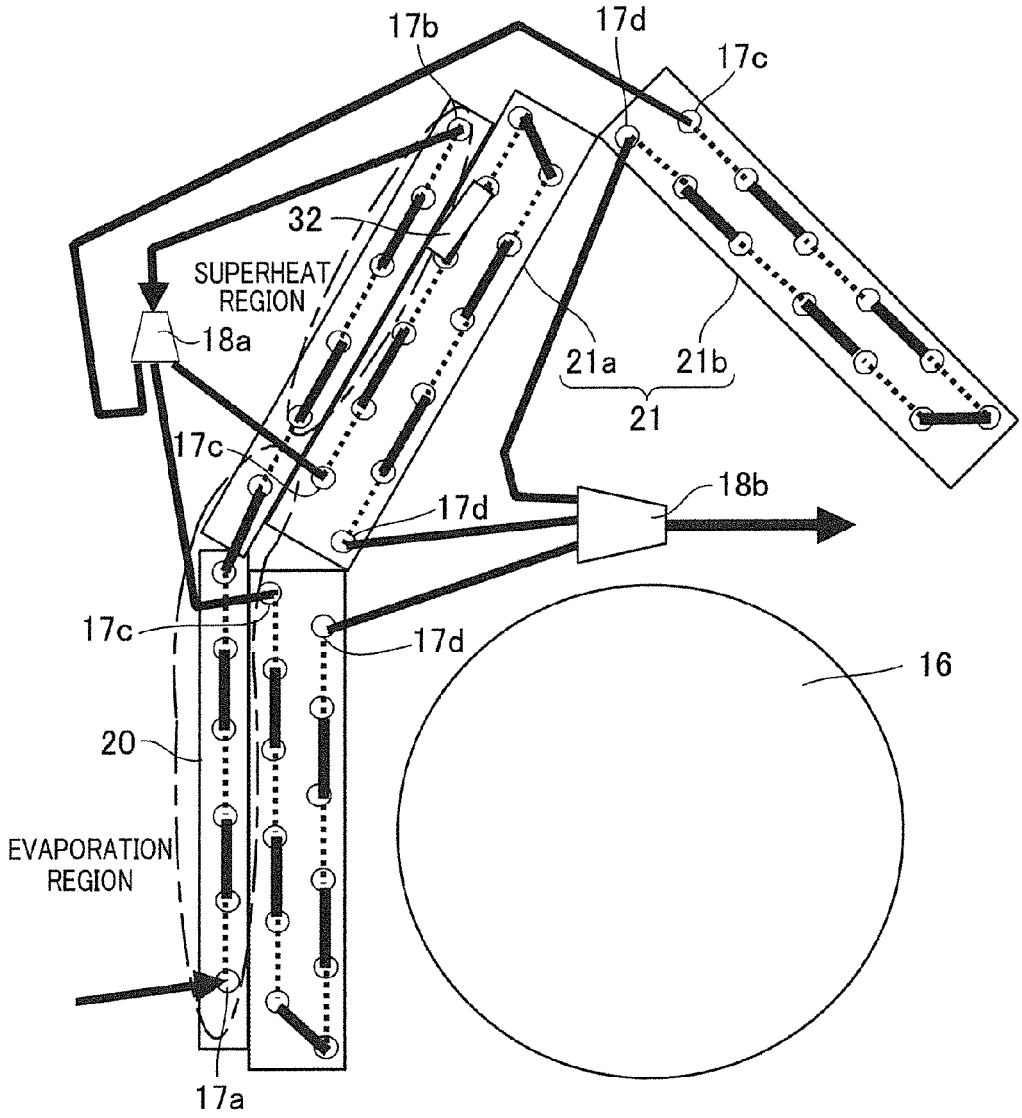
FIG. 3 is a diagram illustrating the structure of an indoor heat exchanger.

In the cooling operation mode and in the predetermined dehumidification operation mode, a liquid refrigerant is supplied through a liquid inlet 17*a* provided in the vicinity of a lower end of the auxiliary heat exchanger 20, and the thus supplied liquid refrigerant flows toward an upper end of the auxiliary heat exchanger 20, as shown in FIG. 3. Then, the refrigerant is discharged through an outlet 17*b* provided in the vicinity of the upper end of the auxiliary heat exchanger 20, and then flows to a branching section 18*a*. The refrigerant is divided at the branching section 18*a* into branches, which are respectively supplied, via three inlets 17*c* of the main heat exchanger 21, to a lower portion and an upper portion of the front heat exchanger 21*a* and to the rear heat exchanger 21*b*. Then, the branched refrigerant is discharged through outlets 17*d*, to merge together at a merging section 18*b*. In the heating operation mode, the refrigerant flows in a reverse direction of the above direction.

When the air conditioner 1 operates in the predetermined dehumidification operation mode, the liquid refrigerant supplied through the liquid inlet 17*a* of the auxiliary heat exchanger 20 all evaporates midway in the auxiliary heat exchanger 20, i.e., before reaching the outlet. Therefore, only a partial area in the vicinity of the liquid inlet 17*a* of the auxiliary heat exchanger 20 is an evaporation region where the liquid refrigerant evaporates. Accordingly, in the operation in the predetermined dehumidification operation mode, only the upstream partial area in the auxiliary heat exchanger 20 is the evaporation region, while (i) the area downstream of the evaporation region in the auxiliary heat exchanger 20 and (ii) the main heat exchanger 21 each functions as a superheat region, in the indoor heat exchanger 14.

Further, the refrigerant having flowed through the superheat region in the vicinity of the upper end of the auxiliary heat exchanger 20 flows through the lower portion of the front heat exchanger 21*a* disposed leeward from a lower portion of the auxiliary heat exchanger 20. Therefore, among the air taken in through the air inlet 2*a*, air having been cooled in the evaporation region of the auxiliary heat exchanger 20 is heated by the front heat exchanger 21*a*, and then blown out from the air outlet 2*b*. Meanwhile, among the air taken in through the air inlet 2*a*, air having flowed through the superheat region of the auxiliary heat exchanger 20 and through the front heat exchanger 21*a*, and air having flowed through the rear heat exchanger 21*b* are blown out from the air outlet 2*b* at a temperature substantially the same as an indoor temperature.

In the air conditioner 1, an evaporation temperature sensor 30 is attached to the outdoor unit 3, as shown in FIG. 1. The evaporation temperature sensor 30 is configured to detect an evaporation temperature and is disposed downstream of the expansion valve 13 in the refrigerant circuit. Further, to the indoor unit 2, there are attached: an indoor temperature sensor 31 configured to detect the indoor temperature (the temperature of the air taken in through the air inlet 2*a* of the indoor unit 2); and an indoor heat exchanger temperature sensor 32 configured to detect whether evaporation of the liquid refrigerant is completed in the auxiliary heat exchanger 20.

As shown in FIG. 3, the indoor heat exchanger temperature sensor 32 is disposed in the vicinity of the upper end of the auxiliary heat exchanger 20 and leeward from the auxiliary heat exchanger 20. Further, in the superheat region in the vicinity of the upper end of the auxiliary heat exchanger 20, the air taken in through the air inlet 2*a* is hardly cooled. Therefore, when the temperature detected by the indoor heat exchanger temperature sensor 32 is substantially the same as the indoor temperature detected by the indoor temperature sensor 31, it is indicated that evaporation is completed midway in the auxiliary heat exchanger 20, and that the area in the vicinity of the upper end of the auxiliary heat exchanger 20 is the superheat region. Furthermore, the indoor heat exchanger temperature sensor 32 is provided to a heat-transfer tube in a middle portion of the indoor heat exchanger 14. Thus, in the vicinity of the middle portion of the indoor heat exchanger 14, detected are the condensation temperature in the heating operation and the evaporation temperature in the cooling operation.

Figure 4:
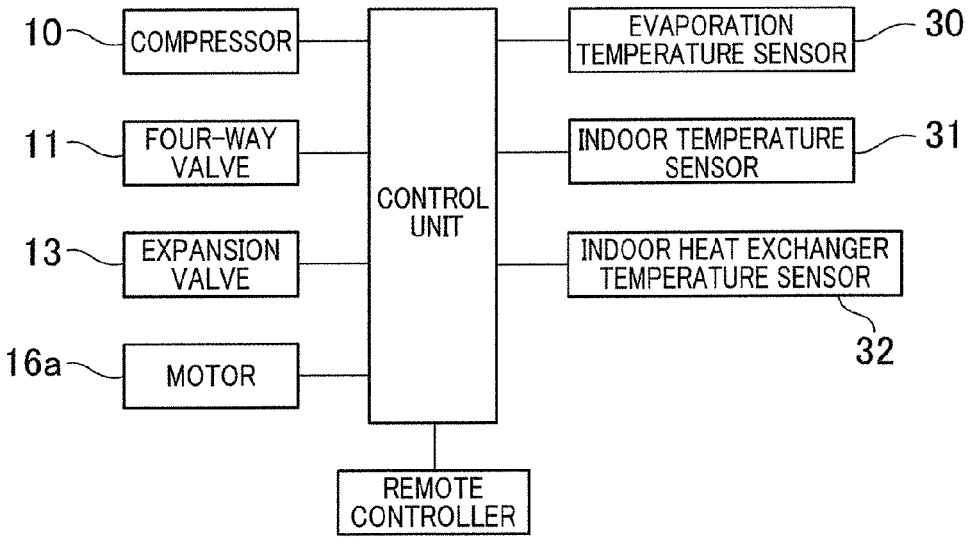
FIG. 4 is a diagram illustrating a control unit of the air conditioner of the embodiment of the present invention.

As shown in FIG. 4, the control unit of the air conditioner 1 is connected with: the compressor 10; the four-way valve 11; the expansion valve 13; a motor 16*a* for driving the indoor fan 16; the evaporation temperature sensor 30; the indoor temperature sensor 31; and the indoor heat exchanger temperature sensor 32. Therefore, the control unit controls the operation of the air conditioner 1 based on: a command from the remote controller (for the start of the operation, for indoor temperature setting, or the like); the evaporation temperature detected by the evaporation temperature sensor 30; the indoor temperature detected by the indoor temperature sensor 31 (the temperature of the intake air); and a heat exchanger middle temperature detected by the indoor heat exchanger temperature sensor 32.

Further, in the air conditioner 1, the auxiliary heat exchanger 20 includes the evaporation region where the liquid refrigerant evaporates and the superheat region downstream of the evaporation region in the predetermined dehumidification operation mode. The compressor 10 and the expansion valve 13 are controlled so that the extent of the evaporation region varies depending on a load. Here, "the extent varies depending on a load" means that the extent varies depending on the quantity of heat supplied to the evaporation region, and the quantity of heat is determined, for example, by the indoor temperature (the temperature of the intake air) and an indoor air volume. Further, the load corresponds to a required dehumidification capacity (required cooling capacity), and the load is determined taking into account, for example, the difference between the indoor temperature and the set temperature.

The compressor 10 is controlled based on the difference between the indoor temperature and the set temperature. When the difference between the indoor temperature and the set temperature is large, the load is high, and therefore the compressor 10 is controlled so that its frequency increases. When the difference between the indoor temperature and the set temperature is small, the load is low, and therefore the compressor 10 is controlled so that its frequency decreases.

The expansion valve 13 is controlled based on the evaporation temperature detected by the evaporation temperature sensor 30. While the frequency of the compressor 10 is controlled as described above, the expansion valve 13 is controlled so that the evaporation temperature falls within a predetermined temperature range (10 to 14 degrees Celsius) close to a target evaporation temperature (12 degrees Celsius). It is preferable that the predetermined evaporation temperature range is constant, irrespective of the frequency of the compressor 10. However, the predetermined range may be slightly changed with the change of the frequency as long as the predetermined range is substantially constant.

Thus, the compressor 10 and the expansion valve 13 are controlled depending on the load in the predetermined dehumidification operation mode, and thereby changing the extent of the evaporation region of the auxiliary heat exchanger 20, and causing the evaporation temperature to fall within the predetermined temperature range.

In the air conditioner 1, each of the auxiliary heat exchanger 20 and the front heat exchanger 21*a* has twelve rows of the heat-transfer tubes. When the number of rows of the tubes functioning as the evaporation region in the auxiliary heat exchanger 20 in the predetermined dehumidification operation mode is not less than a half of the total number of rows of the tubes of the front heat exchanger 21*a*, it is possible to sufficiently increase the extent of the evaporation region of the auxiliary heat exchanger, and therefore a variation in the load is addressed sufficiently. This structure is effective especially under a high load.

Figure 5:
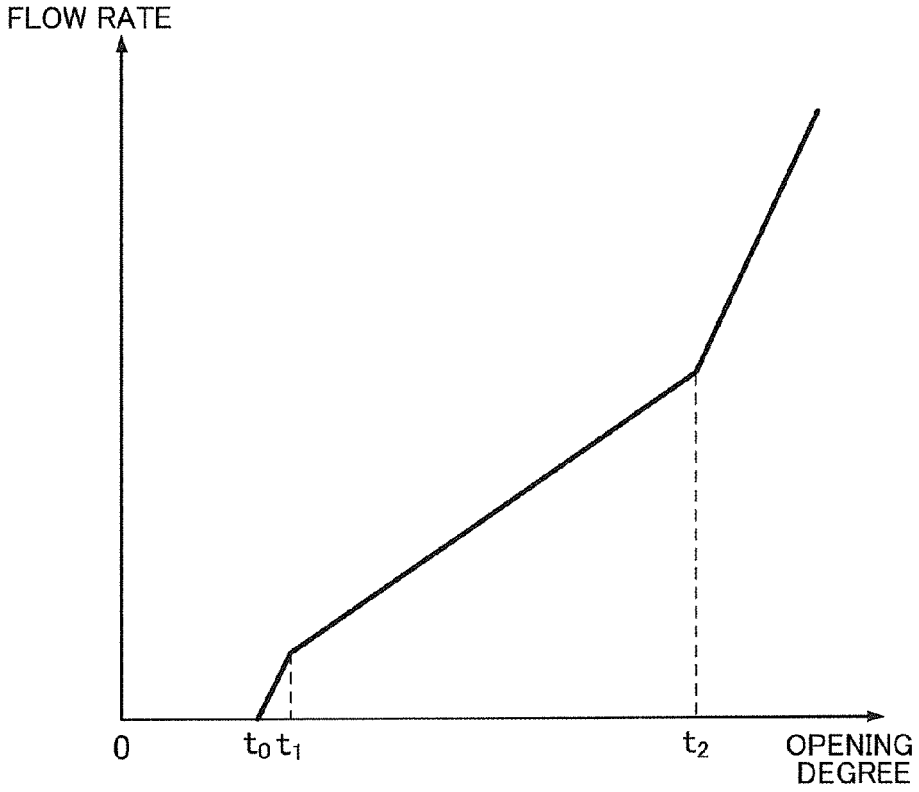
FIG. 5 is a graph showing, byway of example, how the flow rate changes as the opening degree of an expansion valve is changed.
Figure 6:
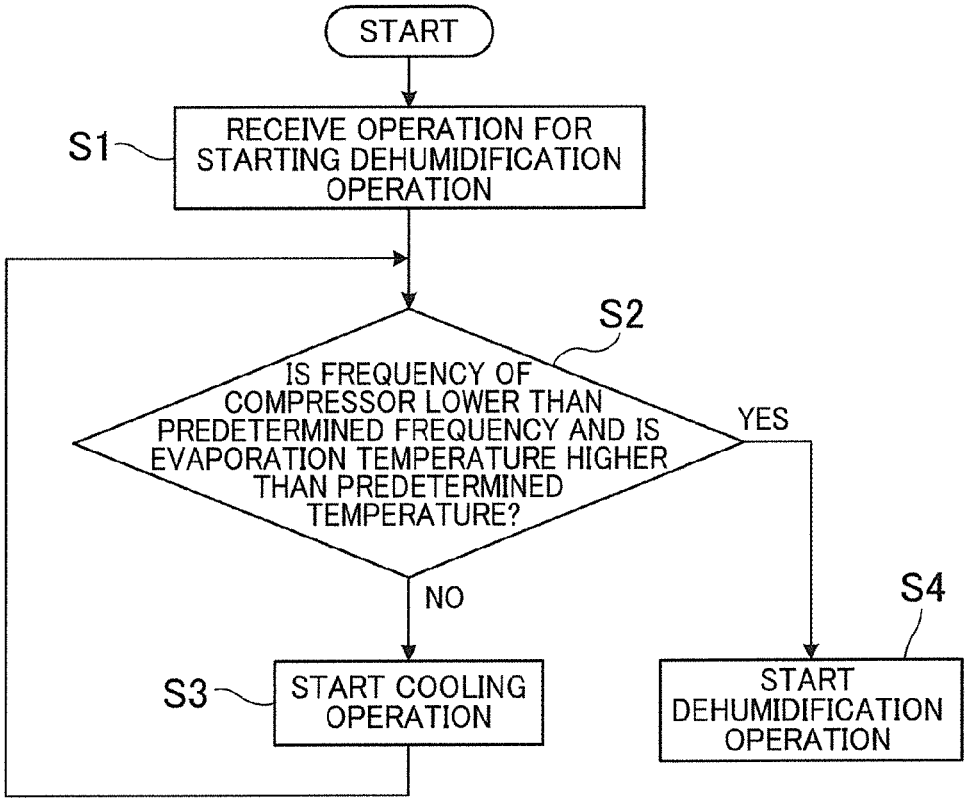
FIG. 6 illustrates the operation of the air conditioner of the embodiment of the present invention.

FIG. 5 is a graph showing how the flow rate changes when the opening degree of the expansion valve 13 is changed. The opening degree of the expansion valve 13 continuously changes with the number of driving pulses input to the expansion valve 13. As the opening degree decreases, the flow rate of the refrigerant flowing through the expansion valve 13 decreases. The expansion valve 13 is fully closed when the opening degree is t0. In the range of the opening degrees t0 to t1, the flow rate increases at a first gradient as the opening degree increases. In the range of the opening degrees t1 to t2, the flow rate increases at a second gradient as the opening degree increases. Note that the first gradient is larger than the second gradient.

The following will describe an example of control executed so that the extent of the evaporation region of the auxiliary heat exchanger 20 varies. For example, when the load increases in the predetermined dehumidification operation mode on the condition that the extent of the evaporation region of the auxiliary heat exchanger 20 is of a predetermined size, the frequency of the compressor 10 is increased and the opening degree of the expansion valve 13 is changed so as to increase. As a result, the extent of the evaporation region of the auxiliary heat exchanger 20 becomes larger than that of the predetermined size, and this increases the volume of the air actually passing through the evaporation region even when the volume of the air taken into the indoor unit 2 is constant.

Meanwhile, when the load becomes lower in the predetermined dehumidification operation mode on the condition that the extent of the evaporation region of the auxiliary heat exchanger 20 is of the predetermined size, the frequency of the compressor 10 is decreased and the opening degree of the expansion valve 13 is changed so as to decrease. Therefore, the extent of the evaporation region of the auxiliary heat exchanger 20 becomes smaller than that of the predetermined size, and this decreases the volume of the air actually passing through the evaporation region even when the volume of the air taken into the indoor unit 2 is constant.

The following will describe actions when the dehumidification operation is selected on the remote controller of the air conditioner 1 to start driving (operation for starting the dehumidification operation). In the air conditioner 1, when the load is high at the execution of the operation for starting the dehumidification operation, the cooling operation is started instead of the dehumidification operation, and then the operation is switched to the dehumidification operation in accordance with the decrease in the load.

In the air conditioner 1, the load is detected based on the frequency of the compressor, which changes in accordance with the difference between the indoor temperature and the set temperature. Therefore, when the frequency of the compressor is lower than a predetermined frequency, the air conditioner 1 determines that the load is low and the dehumidification is not possible in the cooling operation on account of a high evaporation temperature. In this connection, in the air conditioner 1, the evaporation temperature (either the evaporation temperature detected by the evaporation temperature sensor 30 or the heat exchanger middle temperature detected by the indoor heat exchanger temperature sensor 32) is detected. When the detected evaporation temperature is lower than a predetermined temperature, the operation is not switched to the dehumidification operation because sufficient dehumidification is possible even in the cooling operation. To put it differently, the dehumidification operation is started in the air conditioner 1 when the frequency of the compressor is lower than the predetermined frequency and the evaporation temperature is higher than the predetermined temperature.

To begin with, when the operation for starting the dehumidification operation is performed on the remote controller (step S1), whether the frequency of the compressor is smaller than the predetermined frequency and the evaporation temperature is higher than the predetermined temperature is determined (step S2). The predetermined frequency is the upper limit frequency in the dehumidification operation mode. The predetermined temperature is the dehumidification temperature limit in the cooling operation. When the frequency of the compressor is not lower than the predetermined frequency or the evaporation temperature is not lower than the predetermined temperature (step S2: NO), the cooling operation is started (step S3). Then the determination in the step S2 is repeated. In the meanwhile, when in the step S2 the frequency of the compressor is lower than the predetermined frequency and the evaporation temperature is higher than the predetermined temperature (step S2: YES), the dehumidification operation is started (step S4).

<Characteristics of the Air Conditioner of this Embodiment>

In the air conditioner 1 of this embodiment, when the load is high at the execution of the operation for starting the dehumidification operation, sufficient dehumidification is possible even in the cooling operation on account of a low temperature of the heat exchanger, and hence dehumidification and cooling are efficiently and simultaneously done by starting the cooling operation. As the load decreases with the decrease in the room temperature, the operation is switched to the dehumidification operation since dehumidification in the cooling operation becomes impossible on account of an increased evaporation temperature. In this way, the influence of the deterioration of the COP due to the dehumidification is minimized.

Furthermore, in the air conditioner 1 of this embodiment, after the cooling operation is started in response to the operation for starting the dehumidification operation, the switching to the dehumidification operation is not performed when the evaporation temperature is lower than the predetermined temperature. Because in this case the evaporation temperature is lower than the predetermined temperature, dehumidification is possible without the switching from the cooling operation to the dehumidification operation.

While the embodiment of the present invention has been described based on the figures, the scope of the invention is not limited to the above-described embodiment. The scope of the present invention is defined by the appended claims rather than the foregoing description of the embodiment, and various changes and modifications can be made herein without departing from the scope of the invention.

In the above-described embodiment, the auxiliary heat exchanger and the main heat exchanger may be formed into a single unit. In this case, the indoor heat exchanger is formed as a single unit, and a first portion corresponding to the auxiliary heat exchanger is provided on the most windward side of the indoor heat exchanger, and a second portion corresponding to the main heat exchanger is provided leeward from the first portion.

Further, the above-described embodiment deals with the air conditioner configured to operate in the cooling operation mode, in the predetermined dehumidification operation mode, and in the heating operation mode. However, the present invention may be applied to an air conditioner configured to conduct a dehumidification operation in a dehumidification operation mode other than the predetermined dehumidification operation mode, in addition to the dehumidification operation in the predetermined dehumidification operation mode.

INDUSTRIAL APPLICABILITY

The influence of the deterioration of the COP due to the dehumidification operation is minimized when the present invention is employed.

REFERENCE SIGNS LIST

1 air conditioner
2 indoor unit
3 outdoor unit
10 compressor
12 outdoor heat exchanger
13 expansion valve
14 indoor heat exchanger
16 indoor fan
20 auxiliary heat exchanger
21 main heat exchanger

The invention claimed is:

1. An air conditioner comprising a refrigerant circuit in which a compressor, an outdoor heat exchanger, an expansion valve, and an indoor heat exchanger are connected to one another, the air conditioner configured to perform a cooling operation in which the entirety of the indoor heat exchanger functions as an evaporation region and a dehumidification operation in which a part of the indoor heat exchanger functions as the evaporation region, wherein:

the indoor heat exchanger includes a first part that functions as an auxiliary heat exchanger and a second part that functions as a main heat exchanger, the auxiliary heat exchanger being windward of the main heat exchanger;

in the dehumidification operation, the compressor and the expansion valve are controlled so that a part of the auxiliary heat exchanger of the indoor heat exchanger which is most windward and in the vicinity of an liquid inlet functions as the evaporation region while a part of the auxiliary heat exchanger of the indoor heat exchanger which is downstream of the evaporation region and windward of the main heat exchanger functions as a superheat region, and so that an extent of the evaporation region varies depending on a load; and if an evaporation temperature is equal to or lower than a predetermined value when an operation to start the dehumidification operation is selected, the cooling operation is started instead of the dehumidification operation and then when the evaporation temperature exceeds the predetermined value, switching to the dehumidification operation is executed.

2. The air conditioner according to claim 1, wherein, the load is detected based on a difference between an indoor temperature and a set temperature.

3. The air conditioner according to claim 1, wherein, the load is detected based on a frequency of the compressor.

4. The air conditioner according to claim 2, wherein, the load is detected based on a frequency of the compressor.

5. The air conditioner according to claim 1, wherein, after the start of the cooling operation, switching to the dehumidification operation is not executed when an evaporation temperature is lower than a predetermined temperature.

6. The air conditioner according to claim 2, wherein, after the start of the cooling operation, switching to the dehumidification operation is not executed when an evaporation temperature is lower than a predetermined temperature.

7. The air conditioner according to claim 3, wherein, after the start of the cooling operation, switching to the dehumidification operation is not executed when an evaporation temperature is lower than a predetermined temperature.

8. The air conditioner according to claim 4, wherein, after the start of the cooling operation, switching to the dehumidification operation is not executed when an evaporation temperature is lower than a predetermined temperature.

* * * * *